US011174809B1

(12) United States Patent
Han et al.

(10) Patent No.: US 11,174,809 B1
(45) Date of Patent: Nov. 16, 2021

(54) CONTROLLING AN INTERNAL COMBUSTION ENGINE SYSTEM

(71) Applicant: Woodward, Inc., Fort Collins, CO (US)

(72) Inventors: Yi Han, Fort Collins, CO (US); David O. Richards, Fort Collins, CO (US); Jason Barta, Loveland, CO (US); Michael Ryan Buehner, Fort Collins, CO (US); Gregory James Hampson, Boulder, CO (US)

(73) Assignee: Woodward, Inc., Fort Collins, CO (US)

( * ) Notice: Subject to any disclaimer, the term of this patent is extended or adjusted under 35 U.S.C. 154(b) by 0 days.

(21) Appl. No.: 17/122,183

(22) Filed: Dec. 15, 2020

(51) Int. Cl.
*F02D 41/18* (2006.01)

(52) U.S. Cl.
CPC .... *F02D 41/182* (2013.01); *F02D 2200/0414* (2013.01); *F02D 2200/101* (2013.01)

(58) Field of Classification Search
CPC ..... F02D 41/182; F02D 41/1448; F02D 41/1445; F02D 41/1446; F02D 41/1473; F02D 41/1454; F02D 41/0002; F02D 2200/0404; F02D 2200/0414
USPC ..... 123/435, 436, 399, 672, 676, 683, 123/568.19, 568.2, 568.21; 701/103–105, 701/108, 109; 73/114.31, 114.32, 114.33, 73/114.34, 114.36, 114.37, 114.74
See application file for complete search history.

(56) References Cited

U.S. PATENT DOCUMENTS 2,354,179 A 7/1944 Blanc
3,680,534 A 8/1972 Chavant
4,069,797 A 1/1978 Nohira et al.
4,174,027 A * 11/1979 Nakazumi ..... F02M 26/57 477/181
4,183,333 A 1/1980 Aoyama
4,203,400 A 5/1980 Yorioka
4,249,503 A 2/1981 Noguchi et al.
4,271,795 A 6/1981 Nakagawa et al.
5,611,203 A 3/1997 Henderson et al.
(Continued)

FOREIGN PATENT DOCUMENTS

CN 202125377 1/2012
CN 103306858 9/2013
(Continued)

OTHER PUBLICATIONS

Chinese Office Action in CN Appln. No. 201721556484.3, dated May 14, 2018, 3 pages.
(Continued)

*Primary Examiner* — Hai H Huynh
(74) *Attorney, Agent, or Firm* — Fish & Richardson P.C.

(57) ABSTRACT

The method includes the following features. A first pressure upstream of a throttle is received. A temperature upstream of the throttle is received. A second pressure within an intake manifold is received. An engine speed is received. An air flow is estimated based on the received first pressure, the received temperature, the received second pressure, and the received engine speed. Estimating the air flow includes determining one or more models to use for calculating air flow based on the received first pressure and the received second pressure. The models include a throttle flow model, a port flow model, or both.

22 Claims, 4 Drawing Sheets

(56) References Cited

U.S. PATENT DOCUMENTS 5,611,204 A 3/1997 Radovanovic et al.
5,974,802 A 11/1999 Blake
6,003,316 A 12/1999 Baert et al.
6,216,458 B1 4/2001 Alger et al.
6,267,106 B1 7/2001 Feucht
6,343,594 B1 2/2002 Koeslin et al.
6,408,833 B1 6/2002 Faletti
6,425,382 B1 7/2002 Marthaler et al.
6,470,864 B2 10/2002 Kim et al.
6,609,373 B2 8/2003 Coleman et al.
6,609,374 B2 8/2003 Feucht et al.
6,640,542 B2 11/2003 Coleman et al.
6,659,092 B2 12/2003 Coleman et al.
6,729,133 B1 5/2004 Sorter et al.
6,732,524 B2 5/2004 Sponton
6,776,146 B1 8/2004 Ricart-Ugaz et al.
6,810,725 B2 11/2004 Henderson et al.
6,880,535 B2 4/2005 Sorter et al.
6,886,544 B1 5/2005 Bui
6,983,645 B2 1/2006 Webb et al.
7,032,578 B2 4/2006 Liu et al.
7,040,305 B2 5/2006 Sponton
7,140,874 B2 11/2006 Ingalls, Jr. et al.
7,175,422 B2 2/2007 Webb et al.
7,178,492 B2 2/2007 Coleman et al.
7,191,743 B2 3/2007 Weber et al.
7,212,926 B2 5/2007 Ingalls, Jr. et al.
7,252,077 B2 8/2007 Berggren
7,261,096 B2 8/2007 Berggren et al.
7,277,801 B2 10/2007 Webb et al.
7,281,530 B2 10/2007 Usei
7,299,137 B2 11/2007 Bartley et al.
7,311,090 B2 12/2007 Lyons
7,322,193 B2 1/2008 Bering et al.
7,347,086 B2 3/2008 Webb et al.
7,389,770 B2 6/2008 Bertilsson et al.
7,412,335 B2 8/2008 Anderson et al.
7,426,923 B2 * 9/2008 Berggren ..... F02M 35/10262 123/568.18
7,550,126 B2 6/2009 Webb et al.
7,552,722 B1 * 6/2009 Shieh ..... F02M 26/19 123/568.17
7,578,179 B2 8/2009 Krueger et al.
7,597,016 B2 10/2009 Timmons et al.
7,669,411 B2 3/2010 Mallampalli et al.
7,712,314 B1 5/2010 Barnes et al.
7,748,976 B2 7/2010 Burrahm et al.
7,833,301 B2 11/2010 Schindler et al.
7,854,118 B2 12/2010 Vetrovec
7,886,727 B2 2/2011 Ulrey
7,934,492 B2 5/2011 Gerum
8,047,185 B2 11/2011 Ulrey et al.
8,056,340 B2 11/2011 Vaught et al.
8,061,120 B2 11/2011 Hwang
8,425,224 B2 4/2013 Webb et al.
8,589,053 B2 * 11/2013 Keiner ..... F02D 41/02 701/103
8,821,349 B2 9/2014 Cunningham et al.
9,051,900 B2 6/2015 Regner
9,074,540 B2 * 7/2015 Subramanian ..... F02D 41/0072
9,228,519 B2 * 1/2016 Hagari ..... F02D 41/2451
9,239,034 B2 1/2016 Cunningham et al.
9,303,557 B2 4/2016 Ulrey et al.
9,309,837 B2 4/2016 Ulrey et al.
9,448,091 B2 9/2016 Woodsend
9,488,098 B2 11/2016 Sponsky
9,546,591 B2 1/2017 Ge
9,651,004 B2 5/2017 Zhang
9,695,785 B2 7/2017 Roth et al.
9,759,150 B2 * 9/2017 Ohori ..... F02M 61/145
9,816,466 B2 11/2017 Roth et al.
9,863,371 B2 1/2018 El Gammal et al.
10,036,353 B2 7/2018 Shuto et al.
10,316,803 B2 6/2019 Hampson
10,465,637 B2 * 11/2019 Beyer ..... F02M 35/10222
10,634,099 B2 4/2020 Hampson
10,731,580 B2 * 8/2020 Surnilla ..... F02D 41/0072
2003/0111065 A1 6/2003 Blum
2004/0173192 A1 9/2004 Sorter et al.
2005/0247284 A1 11/2005 Weber et al.
2006/0021346 A1 2/2006 Whelan et al.
2006/0124116 A1 * 6/2006 Bui ..... F02M 26/08 123/568.18
2006/0168958 A1 8/2006 Vetrovec
2007/0039321 A1 2/2007 Sheidler
2010/0300413 A1 12/2010 Ulrey et al.
2011/0265772 A1 11/2011 Teng
2012/0180478 A1 7/2012 Johnson et al.
2012/0197550 A1 * 8/2012 Cianflone ..... F02D 41/1454 702/45
2013/0276766 A1 10/2013 Rajkumar
2013/0319381 A1 12/2013 Piaz
2014/0224232 A1 8/2014 Hotta
2014/0238364 A1 8/2014 Beyer et al.
2015/0047317 A1 2/2015 Ulrey et al.
2015/0047618 A1 2/2015 Ulrey et al.
2015/0059713 A1 3/2015 Forshier
2015/0083085 A1 3/2015 Ravenhill et al.
2015/0267650 A1 9/2015 Siuchta et al.
2015/0285192 A1 10/2015 Roth et al.
2015/0369126 A1 12/2015 Knopfel et al.
2016/0319778 A1 11/2016 Shuto et al.
2017/0022941 A1 1/2017 Mallard
2017/0030305 A1 2/2017 Sugiyama
2017/0058839 A1 3/2017 El Gammal et al.
2017/0306899 A1 10/2017 Sanami
2019/0093604 A1 3/2019 Hampson
2019/0257274 A1 8/2019 Hampson
2020/0256266 A1 8/2020 Mastbergen

FOREIGN PATENT DOCUMENTS

CN 103397959 11/2013
CN 203335295 12/2013
CN 203499859 3/2014
CN 204386776 6/2015
CN 207920739 9/2018
DE 181618 3/1907
DE 19587578 6/1999
DE 10054264 5/2002
EP 0653559 5/1995
EP 0732490 9/1996
EP 1020632 B1 7/2000
EP 1859128 B1 7/2008
EP 2562397 2/2013
FR 2902466 12/2007
FR 2893988 B1 1/2008
GB 2313623 12/1997
GB 2356223 5/2001
GB 2421543 6/2006
GB 2438360 11/2007
JP H 09195860 7/1997
JP H 10131742 5/1998
JP H 11324812 11/1999
JP 2000097111 4/2000
JP 2000230460 8/2000
JP 2002221103 8/2002
JP 2004100508 4/2004
JP 2005147010 6/2005
JP 2005147011 6/2005
JP 2005147030 6/2005
JP 2005147049 6/2005
JP 2006132373 5/2006
JP 2007092592 4/2007
JP 2009299591 12/2009
JP 2010101191 5/2010
JP 2013087720 5/2013
JP 2013113097 6/2013
JP 2013170539 9/2013
JP 5530267 6/2014
JP 5916335 5/2016
JP 5935975 6/2016
JP 5938974 6/2016

(56) References Cited

FOREIGN PATENT DOCUMENTS

| | | |
|---|---|---|
| JP | 6035987 | 11/2016 |
| JP | 6051881 | 12/2016 |
| WO | WO2015069330 | 5/2015 |

OTHER PUBLICATIONS

PCT International Search Report and Written Opinion in International Appln. No. PCT/US2018/052637, dated Dec. 21, 2018, 6 pages.
PCT International Search Report and Written Opinion in International Appln. No. PCT/US2020/017155, dated May 27, 2020, 14 pages.

* cited by examiner

CONTROLLING AN INTERNAL COMBUSTION ENGINE SYSTEM

TECHNICAL FIELD

This disclosure relates to controlling an internal combustion system through MAP and estimated MAF control.

BACKGROUND

When controlling an internal combustion engine, an accurate air flow and/or pressure of air going into the engine is determined to accurately calculate the fuel needed for a target air-fuel ratio (AFR). In some instances, engines are designed to run with an AFR being at a stoichiometric AFR, a lean AFR (excess air), or rich AFR (excess fuel). Common ways to determine such air flow and/or pressure include using a mass airflow sensor (MAF), a manifold absolute pressure sensor (MAP), or a combination of the two. Accurately adding fuel to achieve a target AFR is useful for reducing NOx emissions.

SUMMARY

This disclosure describes technologies relating to controlling an internal combustion system.

An example implementation of the subject matter described within this disclosure is a method of controlling an internal combustion engine system. The method includes the following features. A first pressure upstream of a throttle is received. A temperature upstream of the throttle is received. A second pressure within an intake manifold is received. An engine speed is received. An air flow is estimated based on the received first pressure, the received temperature, the received second pressure, and the received engine speed. Estimating the air flow includes determining one or more models to use for calculating air flow based on the received first pressure and the received second pressure. The models include a throttle flow model, a port flow model, or both.

An aspect of the example method, which can be combined with example method alone or in combination with other aspects, includes the following. Determining the one or more models includes determining a pressure drop across the throttle using the received first pressure and the received second pressure. The pressure drop across the throttle is determined to be greater than a specified threshold. an air flow is calculated based on the throttle flow model using the received first pressure, the received temperature, and the received second pressure.

An aspect of the example method, which can be combined with example method alone or in combination with other aspects, includes the following. Determining the one or more models includes determining a pressure drop across the throttle using the received first pressure and the received second pressure. The pressure drop across the throttle is determined to be less than a specified threshold. An air flow based on the port flow model is calculated using the received second pressure, the received temperature, the received engine speed, and a volumetric efficiency table.

An aspect of the example method, which can be combined with example method alone or in combination with other aspects, includes the following. Determining the one or more models includes determining a ratio of a throttle flow model to a port flow model based in part on a pressure drop across the throttle.

An aspect of the example method, which can be combined with example method alone or in combination with other aspects, includes the following. Determining the ratio includes determining that the pressure drop across the throttle is greater than a first specified threshold and determining that the pressure drop across the throttle is less than a second specified threshold. The second specified threshold is greater than the first specified threshold.

An aspect of the example method, which can be combined with example method alone or in combination with other aspects, includes the following. Estimating the air flow includes calculating an air flow based on the throttle flow model using the received first pressure, the received temperature, and the received second pressure. An air flow is calculate based on the port flow model using the received second pressure, the received temperature, the received engine speed, and a volumetric efficiency table. the calculated air flows of the throttle flow model and the port flow model are blended based on the determined ratio. An estimated air flow is determined based on the blended calculated air flows.

An aspect of the example method, which can be combined with example method alone or in combination with other aspects, includes the following. An amount of fuel is admitted into an intake fluid stream. The amount of fuel is based on the estimated air flow and a target air-fuel ratio.

An example of the subject matter within this disclosure is an engine system with the following features. An intake manifold is configured to receive a combustible mixture configured to be combusted within a combustion chamber. A throttle is upstream of the intake manifold. The throttle is configured to at least partially regulate an air flow into the intake manifold. A controller configured to receive a first pressure stream from a first pressure sensor at a first pressure port. The first pressure stream corresponds to a first pressure upstream of a throttle. The controller is configured to receive a temperature stream from a temperature sensor at the first pressure port. The temperature stream corresponds to a temperature upstream of the throttle. The controller is configured to receive an engine speed stream from an engine speed sensor. The engine speed stream corresponds to an engine speed. The controller is configured to receive a second pressure stream from a second pressure sensor at a second pressure port. The second pressure stream corresponds to a second pressure within the intake manifold. The controller is configured to estimate an air flow based on the first pressure stream, the temperature stream, the engine speed stream, and the second pressure stream.

An aspect of the example engine system, which can be combined with example engine system alone or in combination with other aspects, includes the following. The controller is further configured to estimate the air flow with the following steps. A blending ratio of a throttle flow model to a port flow model is determined by the controller based on a pressure drop across the throttle. An air flow is calculated by the controller based on the throttle flow model using the first pressure stream, the temperature stream, and the second pressure stream. An air flow is calculated by the controller based on the port flow model using the second pressure stream, the temperature stream, an engine speed stream, and a volumetric efficiency table. The calculated air flows of the throttle flow model and port flow model are blended by the controller based on the determined blending ratio. An estimated airflow is determined by the controller based on the blended calculated air flows.

An aspect of the example engine system, which can be combined with example engine system alone or in combination with other aspects, includes the following. The controller is further configured to determine the blending ratio with the following steps. The pressure drop across the throttle is determined by the controller to be greater than a first specified threshold. The pressure drop across the throttle is determined by the controller to be less than a second specified threshold. The second specified threshold is greater than the first specified threshold.

An aspect of the example engine system, which can be combined with example engine system alone or in combination with other aspects, includes the following. The controller is further configured to send a signal to a fuel source. The signal corresponds to an amount of fuel to inject into an intake fluid stream. The amount of fuel is at least partially based on the estimated air flow and a target air-fuel ratio.

An example implementation of the subject matter described within this disclosure is an engine system controller configured to perform the following steps. A first pressure stream, corresponding to a first pressure upstream of a throttle, is received by the controller. A temperature stream, corresponding to a temperature upstream of the throttle, is received by the controller. An engine speed stream from an engine speed sensor is received by the controller. The engine speed stream corresponds to an engine speed. A second pressure stream, corresponding to a second pressure within an intake manifold, is received by the controller. One or more models to use for calculating air flow is determined by the controller based on the received first pressure and the received second pressure. The models include a throttle flow model, a port flow model, or both. An air flow is estimated by the controller based on the one or more determined models.

An aspect of the example engine system controller, which can be combined with example engine system controller alone or in combination with other aspects, includes the following. Determining the one or more models to use for calculating air flow includes the controller being further configured to determine a pressure drop across the throttle using the received first pressure and the received second pressure. The controller is further configured to determine if the pressure drop across the throttle is greater than a specified threshold, and if so, calculate an air flow based on the throttle flow model using the received first pressure, the received temperature, and the received second pressure.

An aspect of the example engine system controller, which can be combined with example engine system controller alone or in combination with other aspects, includes the following. Determining the one or more models to use for calculating air flow includes the controller being further configured to determine a pressure drop across the throttle using the received first pressure and the received second pressure. The controller is further configured to determine the if pressure drop across the throttle is less than a specified threshold, and, if so, calculate an air flow based on the port flow model using the received second pressure, the received temperature, the received engine speed, and a volumetric efficiency table.

An aspect of the example engine system controller, which can be combined with example engine system controller alone or in combination with other aspects, includes the following. Determining the one or more models to use for calculating air flow includes the controller being further configured to determine a blending ratio of a throttle flow model to a port flow model based on a pressure drop across the throttle. The controller if further configured to calculate an air flow based on a throttle flow model using the first pressure stream, the temperature stream, and the second pressure stream. The controller is further configured to calculate an air flow based on the port flow model using the second pressure stream, the temperature stream, an engine speed stream, and a volumetric efficiency table. The controller is further configured to blend the calculated air flows of the throttle flow model and the port flow model based on the determined ratio. The controller is further configured to determine an estimated airflow based on the blended calculated air flows.

An aspect of the example engine system controller, which can be combined with example engine system controller alone or in combination with other aspects, includes the following. The controller is further configured to determine the blending ratio with the following steps. The pressure drop across the throttle is determined by the controller to be greater than a first specified threshold. the pressure drop across the throttle is determined by the controller to be less than a second specified threshold. The second specified threshold is greater than the first specified threshold.

An aspect of the example engine system controller, which can be combined with example engine system controller alone or in combination with other aspects, includes the following. The controller is further configured to send a signal to a fuel source. The signal corresponds to an amount of fuel to inject into an intake fluid stream. The amount of fuel is based on the estimated air flow and a target air-fuel ratio.

An aspect of the example engine system controller, which can be combined with example engine system controller alone or in combination with other aspects, includes the following. The controller is further configured to calculate a differential pressure across the throttle based on the first pressure stream and the second pressure stream.

An aspect of the example engine system controller, which can be combined with example engine system controller alone or in combination with other aspects, includes the following. The throttle flow model estimates air flow through the throttle based on the first pressure stream, the temperature stream, and the second pressure stream.

An aspect of the example engine system controller, which can be combined with example engine system controller alone or in combination with other aspects, includes the following. The port flow model estimates air flow through ports between the intake manifold and a combustion chamber defined by an engine block and an engine head. The air flow is estimated based on the engine speed stream, the second pressure stream, and a volumetric efficiency table.

The details of one or more implementations of the subject matter are set forth in the accompanying drawings and the description below. Other features, objects, and advantages of the subject matter will be apparent from the description and drawings, and from the claims.

DESCRIPTION OF DRAWINGS

Like reference numbers and designations in the various drawings indicate like elements.

DETAILED DESCRIPTION

During transient engine operation, it is difficult to accurately control the air-fuel ratio (AFR) that is going into the engine. Controlling the engine's AFR affects engine performance and emissions during all operating conditions. For example, in a typical solution, the throttle flow is estimated with engine port flow by using the standard speed-density equation with a transient compensation table. Such a method does not utilize the correct physical models, which results in higher associated engineering cost and a solution that is not as robust to transient conditions. The method of finding throttle flow by using isentropic flow (e.g., with orifice mass flow equation or an elliptical approximation of this equation) is also sometimes used; however, this solution is known to be less accurate when the delta pressure (dP) across the air intake throttle valve is low. In some instances, such issues are caused by pressure sensor inaccuracies. Alternatively or in addition, such an isentropic flow model can result in inaccuracies when the throttle valve is operated near the closed position (e.g., when the throttle is in the closed to 10% open range). In some instances, such issues are caused by a large change of effective area for a small change in position combined with position sensor inaccuracies, part-to-part variations and leakage paths when the valve is near a closed position, pressure sensor inaccuracies, or any combination of these discrepancies.

This disclosure relates to controlling an internal combustion engine system. A pressure and temperate are detected upstream of a throttle valve. In addition, an engine speed and a manifold pressure are detected. Based on these measurements, an estimated pressure drop across the throttle, in certain instances, is calculated using a throttle model specific to the throttle. Downstream of the throttle is an intake manifold of the engine. A pressure within the intake manifold is measured by the manifold absolute pressure (MAP) sensor. Based on the pressure and temperature detected upstream of the throttle valve, the detected MAP, and an engine speed, an air flow can be estimated with great accuracy, including during transient conditions. This is done by determining one or more models to use for calculating air flow based on the throttle position. The selected models, in certain instances, include a throttle flow model, a port flow model, or both. In instances where both models are used, they are weighted based on the pressure differential between the first pressure and the second pressure. In some instances, a compensation table or equation is used to correct for any errors.

Figure 1:
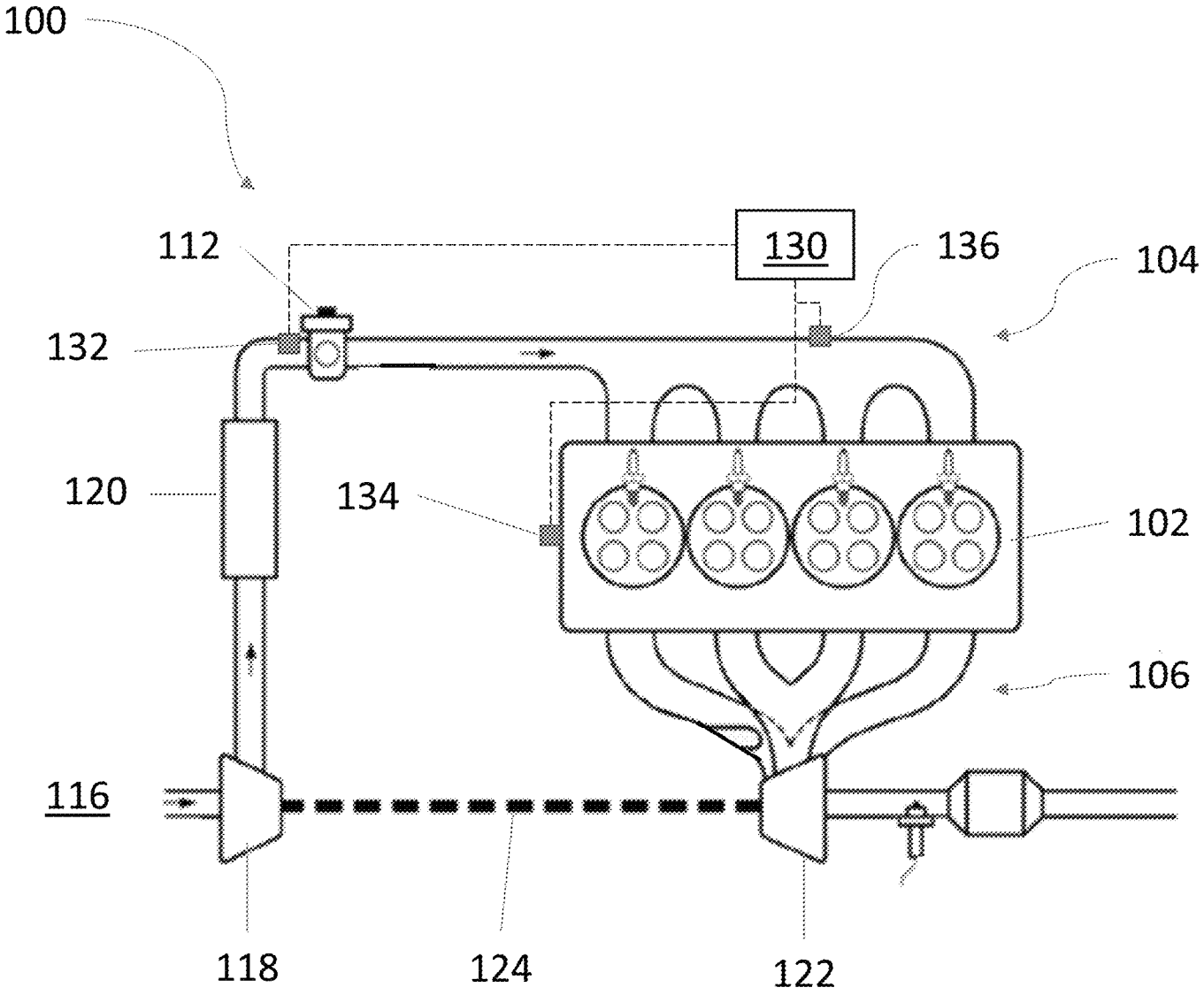
FIG. 1 is a schematic diagram of an example internal combustion engine system.

FIG. 1 shows an example engine system 100. The engine system 100 includes an intake manifold 104 configured to receive a combustible mixture to be combusted within a combustion chamber of the engine block 102. That is, the intake manifold 104 is fluidically coupled to a source of oxygen and a source of fuel. The combustible mixture includes air and any combustible fluid, such as natural gas, atomized gasoline, or atomized diesel. While the illustrated implementation includes a four-cylinder engine block 102, any number of cylinders can be used. Also, while the illustrated implementation includes a piston engine block 102, aspects of this disclosure can be applied to other types of internal combustion engines, such as rotary engines, or gas turbine engines.

A throttle valve 112 is positioned upstream of the intake manifold 104. The throttle 112 is configured to regulate air flow into the intake manifold 104 from the ambient environment 116, for example, by changing a cross-sectional area of a flow passage going through the throttle 112. While illustrated as a single throttle valve 112, some implementations may include multiple throttle valves, for example, one throttle valve for each cylinder bank or one throttle valve for each cylinder. In some implementations, the throttle 112 includes a butterfly valve or a disc valve. Reducing the cross-sectional area of the flow passage through the throttle 112 reduces the flowrate of air flowing through the throttle 112 towards the intake manifold 104. A combination temperature and pressure sensor 132 is positioned just upstream of the throttle 112. This combination temperature and pressure sensor 132 detects the pressure and temperature of the air flow upstream of the throttle 112 and produces a temperature stream and a pressure stream corresponding to the respective detected pressure and temperature stream. A stream in the context of this disclosure is an analog, pneumatic, hydraulic, or digital signal that can be received and interpreted by an engine system controller 130. While primarily described throughout this disclosure as a combined sensor, separate, discrete sensors, in some implementations, are used in lieu of the combination temperature and pressure sensor 132. An engine speed sensor 134 is configured to detect a rotational speed of the engine's crank shaft and produces an engine speed stream corresponding to the detected engine speed. Such a sensor can include a Hall Effect sensor, dynamometer, an optical sensor, or any other sensor adequate for the service.

An exhaust manifold 106 is typically coupled to the engine head and is configured to receive combustion products (exhaust) from a combustion chamber defined by the engine block and engine head. That is, the exhaust manifold 106 is fluidically coupled to an outlet of the combustion chamber. In some implementations, the engine system 100 includes a compressor 118 upstream of the throttle 112. In an engine with a compressor 118 but no throttle 112, such as an unthrottled diesel engine, the throttle 112 is not needed. In some implementations, the compressor 118 includes a centrifugal compressor, a positive displacement compressor, or another type of compressor for increasing a pressure within the intake manifold 104 during engine operation. In some implementations, the engine system 100 includes an intercooler 120 that is configured to cool the compressed air prior to the air entering the intake manifold 104. In the illustrated implementation, the compressor 118 is part of a turbocharger. That is, a turbine 122 is located downstream of the exhaust manifold 106 and rotates as the exhaust gas expands through the turbine 122. The turbine 122 is coupled to the compressor 118, for example, via a shaft 124 and imparts rotation on the compressor 118. While the illustrated implementation utilizes a turbocharger to increase the intake manifold pressure, other methods of compression, in certain instances, are used, for example an electric or engine powered compressor (e.g., supercharger). Alternatively, engine systems lacking forced induction are also within the scope of this disclosure. In some implementations, additional components and subsystems can be included, for example, an exhaust gas recirculation subsystem and associated components. In some implementations, a separate controller 130 or engine control unit (ECU) is used to control and detect various aspects of the system operation. For example, the controller 130 can adjust air-fuel ratios, spark timing, and EGR flow rates based on current operating conditions and parameters sensed by various sensors.

Figure 2:
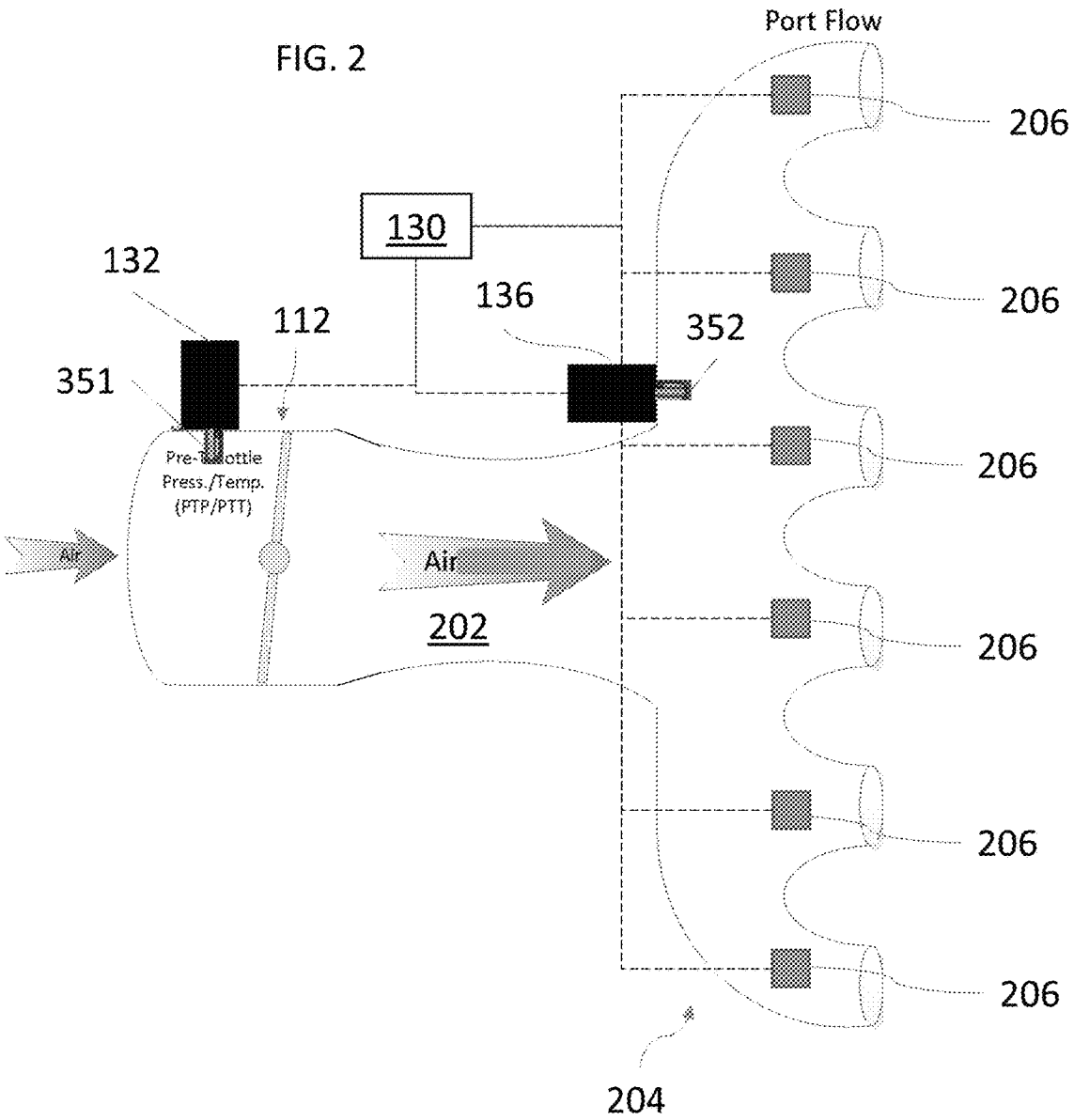
FIG. 2 is a side, half cross-sectional view schematic diagram of an example throttle and intake manifold.

FIG. 2 is a side, half cross-sectional view schematic diagram of an example throttle and intake manifold. A first pressure port 351 is positioned upstream of the throttle 112. The first pressure port 351 provides a location to sense a pressure and a temperature upstream of the throttle 112 by allowing fluid communication between an interior flow passage 202 and the combination temperature and pressure sensor 132. In some implementations, the throttle 112 includes a position sensor. In such implementations, the position sensor detects the position of the throttle 112 and, in certain instances includes an encoder, a Hall Effect sensor, optical sensor, or any other type of sensor with sufficient accuracy and precision.

A second pressure port 352 is positioned within the intake manifold 204. The second pressure port 352 provides a location for the MAP sensor 136 to sense a pressure within the intake manifold 204, which is downstream of the throttle 112, by allowing fluid communication between the interior flow passage 202 and the MAP sensor 136. Based on information, or streams, provided by sensors 132 and 136, an estimated pressure drop across the throttle 112 can be determined. In instances where the pressure drop is above a certain threshold (e.g., when the throttle is in the closed to 10% open range), a detailed model of air flow through the throttle 112 can be used to determine an estimated mass air flow (MAF) based on the calculated pressure drop and the temperature stream.

In instances where the pressure drop is below a certain threshold, a port flow model utilizing a volumetric efficiency table and the speed density equation is used in lieu of or in addition to MAF calculation. A port flow model attempts to calculate a flow into the cylinders through ports in the intake manifold. The speed density equation uses engine speed and MAP to calculate airflow requirements by referring to a preprogrammed lookup table that includes values that equates to the engine's volumetric efficiency under varying conditions of throttle position and engine speed. Since air density changes with air temperature, an intake manifold-mounted sensor is also used. An operational example of such an instance includes when the throttle 112 is in the open or nearly opened position (e.g., when the throttle is in the open to 60% open range).

Fuel injectors 206 are located at an intake port of each cylinder. As illustrated, there are six ports for the intake manifold 204 that are meant to feed six cylinders. In some implementations, greater of fewer ports and cylinders are used, for example, four cylinders and four ports, or 8 cylinders and 8 ports can be used without departing from this disclosure. While the fuel injectors 206 are illustrated as arranged in a port injection arrangement, other injection arrangements or fuel sources can be used to admit fuel without departing from this disclosure. For example, in some implementations, a single point injection, a gas mixer, or a direct injection arrangement is used.

In addition to the MAF or speed equation calculations previously described, in certain implementations, an air-fuel-exhaust mass flow rate is determined by comparing the pressure sensed by additional pressure sensors. A difference between the mass air-flow rate and the air-fuel-exhaust flow rate, in some instances, is used to calculate an EGR mass flow rate. In certain instances, such a calculation, in some instances, is performed by the controller 130 (FIG. 1). In some instances, the MAF and EGR flow rates are used as inputs for the controller 130 to adjust a variety of parameters within the engine system 100. In certain instances, the controller 130 is an engine control unit (ECU) that controls some or all aspects of the engine system's 100 operation, such as fuel supply, air, ignition and/or other engine operational parameters. In certain instances, the controller 130 is a separate control unit from the engine system's 100 ECU. The controller 130 also need not send actuation and/or control signals to the engine system 100, but could instead provide information, such as the MAF and EGR flow rates, to an ECU for use by the ECU in controlling the engine system 100.

Figure 3:
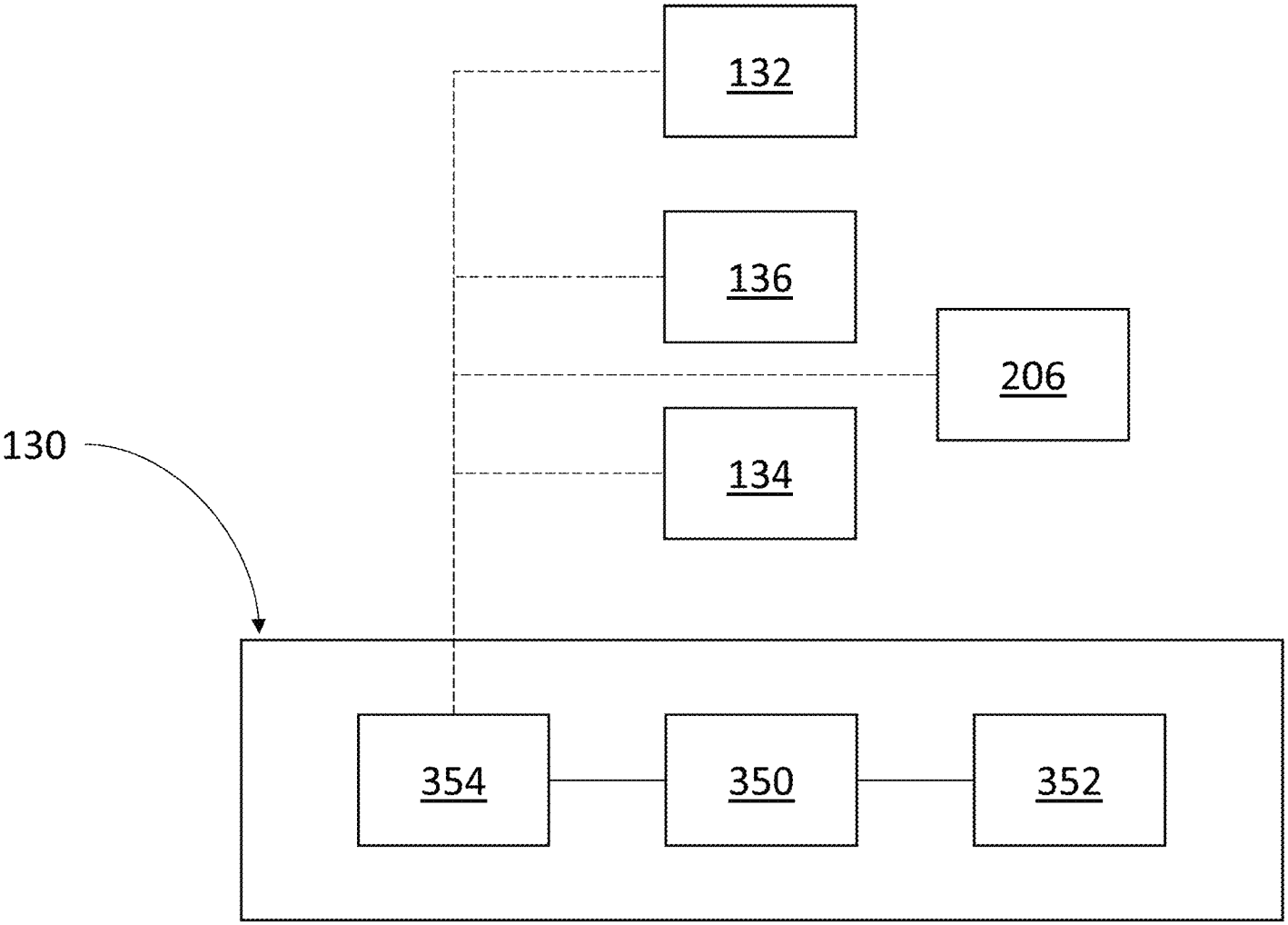
FIG. 3 is a block diagram of an example controller that can be used with aspects of this disclosure.

FIG. 3 is a block diagram of an example controller 130 that can be used with aspects of this disclosure. The controller 130 can, among other things, monitor parameters of the system and send signals to actuate and/or adjust various operating parameters of the system. As shown in FIG. 3, the controller 130, in certain instances, includes a processor 350 (e.g., implemented as one processor or multiple processors) and a memory 352 (e.g., implemented as one memory or multiple memories) containing instructions that cause the processors 350 to perform operations described herein. The processors 350 are coupled to an input/output (I/O) interface 354 for sending and receiving communications with components in the system, including, for example, the combination temperature and pressure sensor 132, the engine speed sensor 134, and the MAP sensor 136. In certain instances, the controller 130 can additionally communicate status with and send actuation and/or control signals to one or more of the various system components (including the throttle 112 and the fuel injectors 206 of the engine system 100, as well as other sensors (e.g., pressure sensors, temperature sensors, knock sensors, and other types of sensors) provided in the engine system 100.

Figure 4:
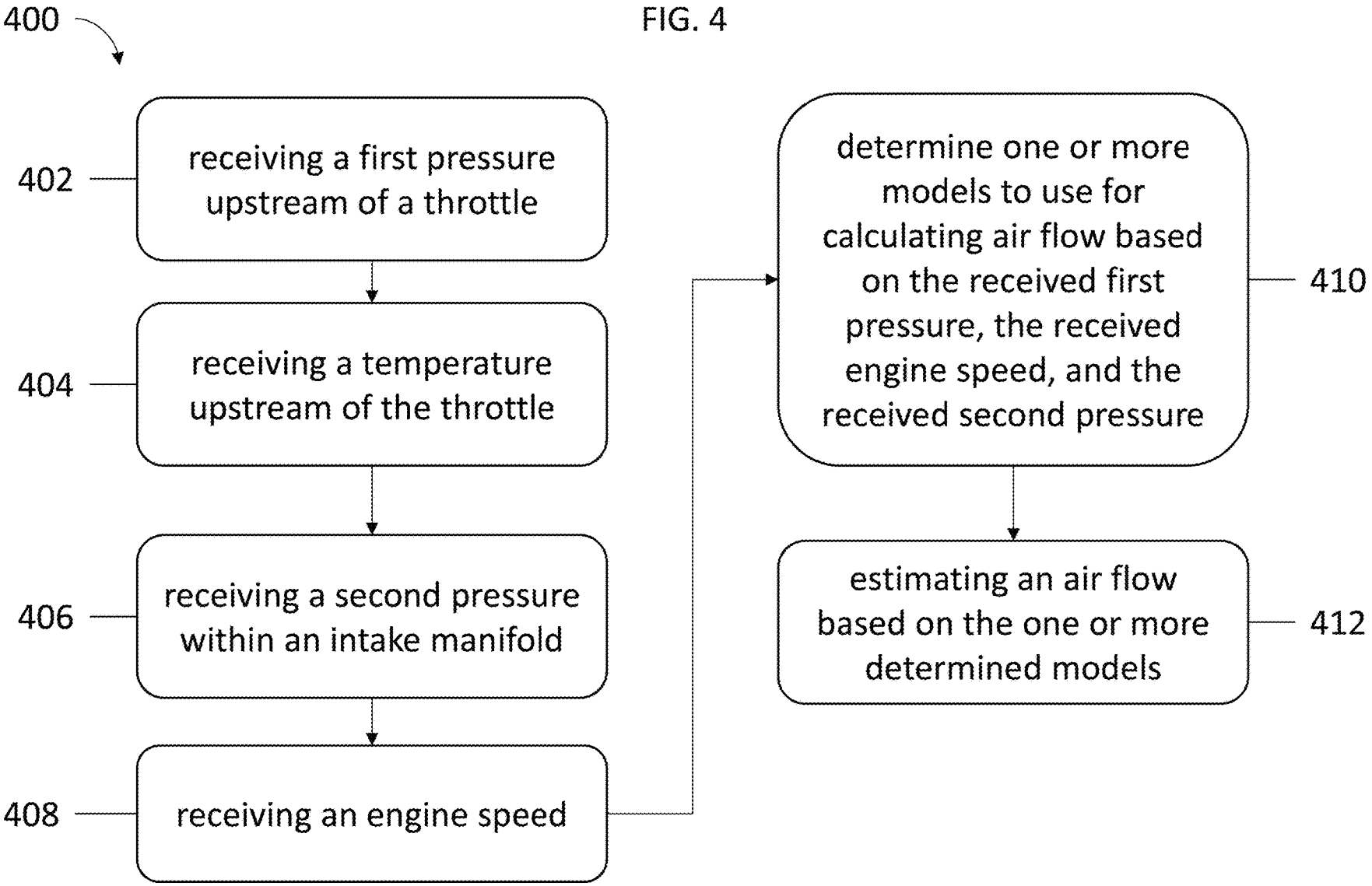
FIG. 4 is a flowchart of an example method that can be used with aspects of this disclosure.

FIG. 4 is a flowchart of a method 400 that can be performed all or in part by the controller 130. At 402, a first pressure stream, corresponding to a first pressure stream upstream of the throttle 112, is received by the controller 130. At 404, a temperature stream, corresponding to a temperature upstream of the throttle 112, is received by the controller 130. At 406, a second pressure stream corresponding to an absolute pressure within the intake manifold 204, is received by the controller 130. At 408, an engine speed stream, corresponding to an engine speed, is received by the controller 130. After the streams are received by the controller 130, at 410, the controller 130 determines one or more models to use for calculating a mass air flow based on the throttle position. The controller 130 chooses between a throttle flow model, a port flow model, or both. Based on the one or more determined flow models, at 412, the controller 130 estimates the air flow based on the one or more determined models.

To determine which model to use for calculating mass air flow, the controller 130 determines a ratio of a throttle flow model to a port flow model based on the throttle position stream. For example, if the throttle 112 is in a closed or near-closed position, then the throttle flow model will be more heavily weighted than the port flow model. In other words, when the controller 130 determines that the pressure drop across the throttle 112 is greater than a specified threshold, then the throttle flow model is used. Conversely, if the throttle 112 is in an open or near-open position, then the port nozzle flow model will be more heavily weighted than the throttle flow model. In other words, if the pressure drop across the throttle 112 is below a second specified threshold that is lower than the first threshold, then the port flow model is used. If the pressure drop across the throttle 112 is between the first threshold and the second threshold, then a blend of the two models is used. Based on the throttle flow model, the air flow is calculated using the first pressure stream, the temperature stream, and the second pressure stream. In other words, a differential pressure across the throttle 112 is calculated by the controller 130 based on the first pressure stream, the temperature stream, and the second pressure stream. Based on the port flow model, the air flow is calculated using the second pressure stream, the temperature stream, the engine speed stream, and a volumetric efficiency table. Once the controller 130 has calculated the airflow based on both of the flow models, the controller 130 blends the calculated air flows of both the throttle flow model and the port flow model based on the determined blending ratio. The controller 130 then determines an estimated airflow based on the blended calculated air flows.

In certain instances, the controller 130 can control many aspects of the internal combustion engine system 100 (FIG. 1). For example, the controller 130 can send a signal to a fuel injector or multiple injectors. Such a signal corresponds to an amount of fuel to inject into an intake fluid stream. The amount of fuel is based on the estimated air flow, the combined air flow and recirculated gas exhaust flow, a target air-fuel ratio, or a combination. Target air-fuel ratio values corresponding to various parameters, in certain instances, is stored in a table within the memory 452 of the controller 130, or, in certain instances, is calculated based on engine parameters, for example, with a PID controller.

While this disclosure contains many specific implementation details, these should not be construed as limitations on the scope of what may be claimed, but rather as descriptions of features specific to particular implementations of particular subject matters. Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the implementations described above should not be understood as requiring such separation in all implementations, and it should be understood that the described components and systems can generally be integrated together in a single product or packaged into multiple products.

A number of implementations of the subject matter have been described. Nevertheless, it will be understood that various modifications may be made. Accordingly, other implementations are within the scope of the following claims.

What is claimed is:

1. A method of controlling an internal combustion engine system, the method comprising:

receiving a sensed value of a first pressure upstream of a throttle;

receiving a sensed value of a temperature upstream of the throttle;

receiving a sensed value of a second pressure within an intake manifold;

receiving a sensed value of an engine speed; and estimating an air flow based on the received first pressure, the received temperature, the received second pressure, and the received engine speed, wherein estimating the air flow comprises:

determining one or more models to use for calculating air flow based on the received first pressure and the received second pressure, the models including a throttle flow model, a port flow model, or both.

2. The method of claim 1, wherein determining the one or more models comprises:

determining a pressure drop across the throttle using the received first pressure and the received second pressure;

determining the pressure drop across the throttle is greater than a specified threshold; and calculating an air flow based on the throttle flow model using the received first pressure, the received temperature, and the received second pressure.

3. The method of claim 1, wherein determining the one or more models comprises:

determining a pressure drop across the throttle using the received first pressure and the received second pressure;

determining the pressure drop across the throttle is less than a specified threshold; and calculating an air flow based on the port flow model using the received second pressure, the received temperature, the received engine speed, and a volumetric efficiency table.

4. The method of claim 1, wherein determining the one or more models comprises:

determining a ratio of a throttle flow model to a port flow model based in part on a pressure drop across the throttle.

5. The method of claim 4, wherein determining the ratio comprises:

determining that the pressure drop across the throttle is greater than a first specified threshold; and determining that the pressure drop across the throttle is less than a second specified threshold, the second specified threshold being greater than the first specified threshold.

6. The method of claim 4, wherein estimating the air flow comprises:

calculating an air flow based on the throttle flow model using the received first pressure, the received temperature, and the received second pressure;

calculating an air flow based on the port flow model using the received second pressure, the received temperature, the received engine speed, and a volumetric efficiency table;

blending the calculated air flows of the throttle flow model and the port flow model based on the determined ratio; and determining an estimated air flow based on the blended calculated air flows.

7. The method of claim 6, comprising admitting an amount of fuel into an intake fluid stream, the amount of fuel being based on the estimated air flow and a target air-fuel ratio.

8. The method of claim 1, wherein receiving the sensed value comprises receiving a first pressure stream from a first pressure sensor at a first pressure port, the first pressure stream corresponding to a first pressure upstream of a throttle, and receiving a sensed value of a second pressure comprises a second pressure stream from a second pressure sensor at a second pressure port, the second pressure stream corresponding to a second pressure within the intake manifold.

9. An engine system comprising:

an intake manifold configured to receive a combustible mixture configured to be combusted within a combustion chamber;

a throttle upstream of the intake manifold, the throttle configured to at least partially regulate an air flow into the intake manifold;

a controller configured to:

receive a first pressure stream from a first pressure sensor at a first pressure port, the first pressure stream corresponding to a first pressure upstream of a throttle;

receive a temperature stream from a temperature sensor at the first pressure port, the temperature stream corresponding to a temperature upstream of the throttle;

receive an engine speed stream from an engine speed sensor, the engine speed stream corresponding to an engine speed;

receive a second pressure stream from a second pressure sensor at a second pressure port, the second pressure stream corresponding to a second pressure within the intake manifold; and estimate an air flow based on the first pressure stream, the temperature stream, the engine speed stream, and the second pressure stream.

10. The engine system of claim 9, wherein the controller is further configured to estimate the air flow with the following steps:

determine a blending ratio of a throttle flow model to a port flow model based on a pressure drop across the throttle;

calculate an air flow based on the throttle flow model using the first pressure stream, the temperature stream, and the second pressure stream;

calculate an air flow based on the port flow model using the second pressure stream, the temperature stream, an engine speed stream, and a volumetric efficiency table;

blend the calculated air flows of the throttle flow model and port flow model based on the determined blending ratio; and determine an estimated airflow based on the blended calculated air flows.

11. The engine system of claim 10, wherein the controller is further configured to determine the blending ratio with the following steps:

determine that the pressure drop across the throttle is greater than a first specified threshold; and determine that the pressure drop across the throttle is less than a second specified threshold, the second specified threshold being greater than the first specified threshold.

12. The engine system of claim 10, wherein the controller is further configured to send a signal to a fuel source, the signal corresponding to an amount of fuel to inject into an intake fluid stream, the amount of fuel being at least partially based on the estimated air flow and a target air-fuel ratio.

13. An engine system controller configured to:

receive a first sensed pressure stream corresponding to a first pressure upstream of a throttle;

receive a sensed temperature stream corresponding to a temperature upstream of the throttle;

receive a sensed engine speed stream from an engine speed sensor, the engine speed stream corresponding to an engine speed;

receive a second sensed pressure stream corresponding to a second pressure within an intake manifold;

determine one or more models to use for calculating air flow based on the received first pressure and the received second pressure, the models including a throttle flow model, a port flow model, or both; and estimate an air flow based on the one or more determined models.

14. The engine system controller of claim 13, wherein to determine the one or more models to use for calculating air flow comprises the controller being further configured to:

determine a pressure drop across the throttle using the received first pressure and the received second pressure;

determine the pressure drop across the throttle is greater than a specified threshold; and calculate an air flow based on the throttle flow model using the received first pressure, the received temperature, and the received second pressure.

15. The engine system controller of claim 13, wherein to determine the one or more models to use for calculating air flow comprises the controller being further configured to:

determine a pressure drop across the throttle using the received first pressure and the received second pressure;

determine the pressure drop across the throttle is less than a specified threshold; and calculate an air flow based on the port flow model using the received second pressure, the received temperature, the received engine speed, and a volumetric efficiency table.

16. The engine system controller of claim 13, wherein to determine the one or more models to use for calculating air flow comprises the controller being further configured to:

determine a blending ratio of a throttle flow model to a port flow model based on a pressure drop across the throttle;

calculate an air flow based on a the throttle flow model using the first pressure stream, the temperature stream, and the second pressure stream;

calculate an air flow based on the port flow model using the second pressure stream, the temperature stream, an engine speed stream, and a volumetric efficiency table;

blend the calculated air flows of the throttle flow model and the port flow model based on the determined ratio; and determine an estimated airflow based on the blended calculated air flows.

17. The engine system controller of claim 16, wherein the controller is further configured to determine the blending ratio with the following steps:

determine that the pressure drop across the throttle is greater than a first specified threshold; and determine that the pressure drop across the throttle is less than a second specified threshold, the second specified threshold being greater than the first specified threshold.

18. The engine system controller of claim 16, further configured to send a signal to a fuel source, the signal corresponding to an amount of fuel to inject into an intake fluid stream, the amount of fuel being based on the estimated air flow and a target air-fuel ratio.

19. The engine system controller of claim 13, further configured to calculate a differential pressure across the throttle based on the first pressure stream and the second pressure stream.

20. The engine system controller of claim 13, wherein the throttle flow model estimates air flow through the throttle based on the first pressure stream, the temperature stream, and the second pressure stream.

21. The engine system controller of claim 13, wherein the port flow model estimates air flow through ports between the intake manifold and a combustion chamber defined by an engine block and an engine head, wherein the air flow is estimated based on the engine speed stream, the second pressure stream, and a volumetric efficiency table.

22. The engine system controller of claim 13, further comprising:

creating the first sensed pressure stream by a first pressure sensor at a first pressure port, the first pressure stream corresponding to a first pressure upstream of a throttle; and creating the second sensed pressure stream by a second pressure sensor at a second pressure port, the second pressure stream corresponding to a second pressure within the intake manifold.

* * * * *